United States Patent [19]

Okano et al.

[11] Patent Number: 5,070,368

[45] Date of Patent: Dec. 3, 1991

[54] DEVELOPING APPARATUS

[75] Inventors: Tokiyuki Okano, Yamatokoriyama; Kiyoshi Inamoto, Sakai; Kazuyuki Ohnishi, Nara; Hidetomo Nishiyama, Yamatokoriyama; Kazunori Sohda, Nara; Masato Tokishige, Nara; Yoichi Shimazawa, Nara, all of Japan

[73] Assignee: Sharp Kabushiki Kaisha, Osaka, Japan

[21] Appl. No.: 475,344

[22] Filed: Feb. 5, 1990

[30] Foreign Application Priority Data

Feb. 15, 1989 [JP] Japan ..... 1-16597[U]

[51] Int. Cl.[5] ..... G03G 21/00

[52] U.S. Cl. ..... 355/246; 118/689; 118/692; 355/208; 355/209; 355/326

[58] Field of Search ..... 118/689, 690, 691, 692, 118/693, 694; 355/208, 209, 245, 246, 260, 326

[56] References Cited

U.S. PATENT DOCUMENTS 3,910,232 10/1975 Kondo et al. ..... 355/326 X
4,647,185 3/1987 Takeda et al. ..... 355/246 X
4,897,690 1/1990 Takano ..... 355/208
4,951,091 8/1990 Nawata ..... 355/246 X

FOREIGN PATENT DOCUMENTS 58-72174 4/1983 Japan ..... 355/246
60-60054 2/1985 Japan .

*Primary Examiner*—A. T. Grimley
*Assistant Examiner*—Christopher Horgan

[57] ABSTRACT

A developing apparatus which includes a plurality of developing units individually provided with sensors for detecting amounts of toner accommodated therein, includes a judging device for judging whether or not sensor outputs of other developing units are below a replenishable amount when a sensor output of one developing unit falls below a replenishing requiring amount, and a replenishing display device for urging toner replenishment, based on the result of the above judgement, with respect to the developing unit having the sensor output below the replenishing requiring amount and the developing unit whose sensor output is below the replenishable amount.

9 Claims, 3 Drawing Sheets

DEVELOPING APPARATUS

BACKGROUND OF THE INVENTION

The present invention generally relates to a developing apparatus for use in an image forming arrangement based on electrophotography and more particularly, to a developing apparatus of the above type including a plurality of developing units.

Commonly, in an image forming arrangement based on the electrophotographic process, it is so arranged that toner is supplied from a developing apparatus onto a surface of a photosensitive member on which an electrostatic latent image is formed so as to develop the latent image into a visible image. In the image forming apparatus of the above described type, in the case where a color image is to be formed, images for respective colors for three primaries in the subtractive mixture are formed on the surface of the photosensitive member so as to be composed or combined. For correctly effecting such color composition, it is necessary to avoid mixture of respective colors in the developing process for each color, and in the conventional color image forming arrangement, developing apparatuses are formed into units for the respective colors, with each of the developing units being provided with a separate magnet roller for supplying toner onto the surface of the photosensitive member.

In the developing apparatus having a plurality of developing units as described above, it has been a practice to independently detect the amount of toner accommodated in each developing unit, thereby to effect a display to urge toner replenishment with respect to the developing unit showing the accommodated toner amount below a predetermined value, so that an operator recognizes said display and replenishes the toner in the color accommodated in the developing unit with respect to said developing unit which has decreased in the accommodated toner amount.

However, since the toner consuming amounts in the respective developing units are not generally uniform, it is seldom that the accommodated toner amounts simultaneously fall below the predetermined value in the plurality of developing units, and thus, it is required to independently replenish toner with respect to each of the developing units, resulting in such an inconvenience that frequency for the toner replenishments is undesirably increased and more complicated, with a consequent reduction in the working efficiency.

SUMMARY OF THE INVENTION

Accordingly, an essential object of the present invention is to provide a developing apparatus having a plurality of developing units, which is so arranged that when replenishment of toner becomes necessary in one developing unit, the amounts of toner accommodated in other developing units are also checked, so as to simultaneously effect toner replenishment with respect to the other developing units whose accommodated toner amounts are reduced to such an extent as will permit replenishment of toner by a predetermined amount, whereby the frequency of toner replenishment work is reduced and working efficiency of the image forming apparatus is improved.

Another object of the present invention is to provide developing apparatus of the above described type, which is simple in construction and stable in functioning with high reliability, and can be readily incorporated into various image forming apparatuses at low cost.

In accomplishing these and other objects, according to one preferred embodiment of the present invention, there is provided a developing apparatus which includes a plurality of developing units individually provided with sensor means for detecting amounts of toner accommodated therein, and is characterized in that there are further provided a judging means for judging whether or not sensor outputs of other developing units are below a replenishable amount when a sensor output of one developing unit falls below a replenishing requiring amount, and a replenishing display means for urging toner replenishment, based on the result of said judgement, with respect to the developing unit having the sensor output below the replenishing requiring amount and the developing unit whose sensor output is below the replenishable amount.

More specifically, as shown in FIG. 1, according to the present invention, it is so arranged that the outputs of the sensors SR provided on respective ones of the plurality of developing units DU are applied to a control section CN. In the case where some sensor outputs fall below the replenishing requiring amount (toner amount in a state where there is almost no toner in the developing unit), the control unit outputs to a display section DP, signals corresponding to the developing units DU provided with such sensors SR. The display section DP effects the display for urging toner replenishment with respect to the equivalent developing units DU according to said signals. Simultaneously with the above function, the control section CN judges whether or not there are any sensors SR showing the amount below the replenishable amount (toner amount in a state where the accommodated amount has been reduced to such an extent that toner more than a predetermined amount of toner can be replenished) in the other sensor outputs, and outputs to the display section DP, signals corresponding to the developing units DU having the sensors SR whose output is below the replenishable amount. According to said signals, the display section DP urges replenishment of toner with respect to the developing unit DU having the sensor output showing the amount less than the replenishable amount.

In the developing apparatus according to the present invention as described above, it is possible to simultaneously effect toner replenishment with respect to the developing unit whose accommodated toner amount has been reduced below the replenishable amount, during toner replenishment with respect to the developing unit whose accommodated toner amount has fallen below the required replenishing amount. As described above, if the toner replenishment can be simultaneously effected with respect to the plurality of developing units, the frequency of the toner replenishing work may be reduced, with a consequent improvement of the working efficiency of the image forming arrangement.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
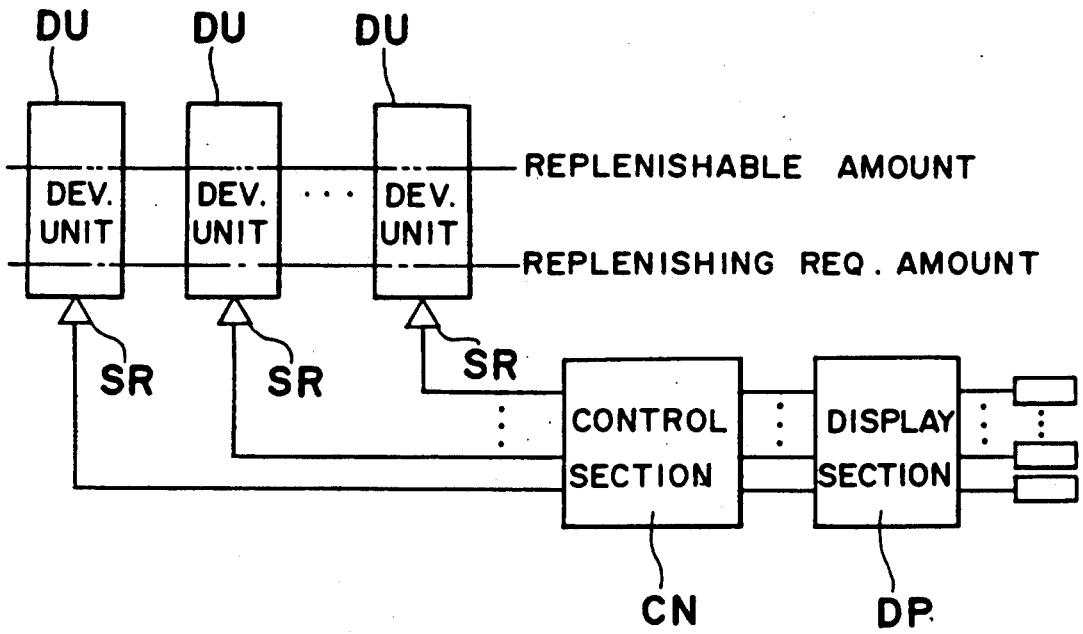
FIG. 1 is a block diagram for explaining functioning of a control system for a developing apparatus according to the present invention (already referred to)

Before the description of the present invention proceeds, it is to be noted that like parts are designated by like reference numerals throughout the accompanying drawings.

Figure 2:
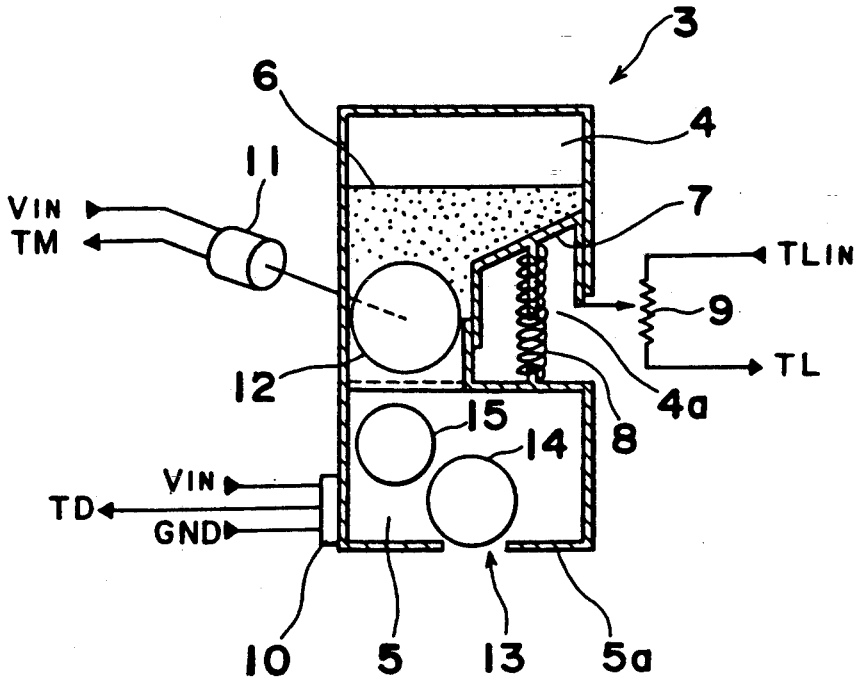
FIG. 2 is a schematic side sectional view showing construction of one of the developing units employed in the developing apparatus according to one preferred embodiment of the present invention.

Referring now to the drawings, there is shown in FIG. 2, a side sectional view of a plurality of one of developing units 3 which constitutes part of a developing apparatus according to one preferred embodiment of the present invention.

As shown in FIG. 2, a single developing unit 3 generally includes a developing tank 5 in which a magnet roller 14 and a stirring roller 15 are rotatably provided, and a hopper 4 located at the upper portion of said developing tank 5 and rotatably accommodating a replenishing roller 12 therein.

The developing tank 5 which accommodates a developing material composed of toner and carrier therein, is formed in its bottom wall 5*a*, with an opening 13, through which part of the magnet roller 14 is exposed to confront a photosensitive surface of a photosensitive member or photoreceptor (not shown). Of the developing material containing toner and carrier, only the toner is supplied onto the photosensitive surface. Accordingly, as the toner is consumed, toner concentration in the developing material is to be lowered. On the outer wall surface of the developing tank 5, there is provided a magnetic permeability sensor 10 which detects the toner concentration within the developing tank 5, and its output (i.e. a toner concentration signal) TD is applied to a control circuit to be described later The output of this permeability sensor 10 is increased as the toner within the developing tank 5 is reduced, with a consequent lowering of the toner concentration.

In the hopper 4, toner 6 to be fed to the developing tank 5 is accommodated. The replenishing roller 12 rotatably supported at a communicating portion between the hopper 4 and the developing tank 5 is driven for rotation by a motor 11. Meanwhile, at one portion of the hopper 4 in a position adjacent to the roller 12, there is formed a recess 4*a*, in which an actuator 7 urged upwardly by a spring 8 is movably provided. Displacement of the actuator 7 is transmitted to a level sensor 9 constituted by a variable resistor. This level sensor 9 is arranged to detect variation in the amount of toner 6 accommodated within the hopper 4 in response to displacement of the actuator 7 so as to output toner level signal TL. The output of the toner level sensor 9 is decreased as the amount of the toner accommodated in the hopper 4 is reduced.

Figure 3:
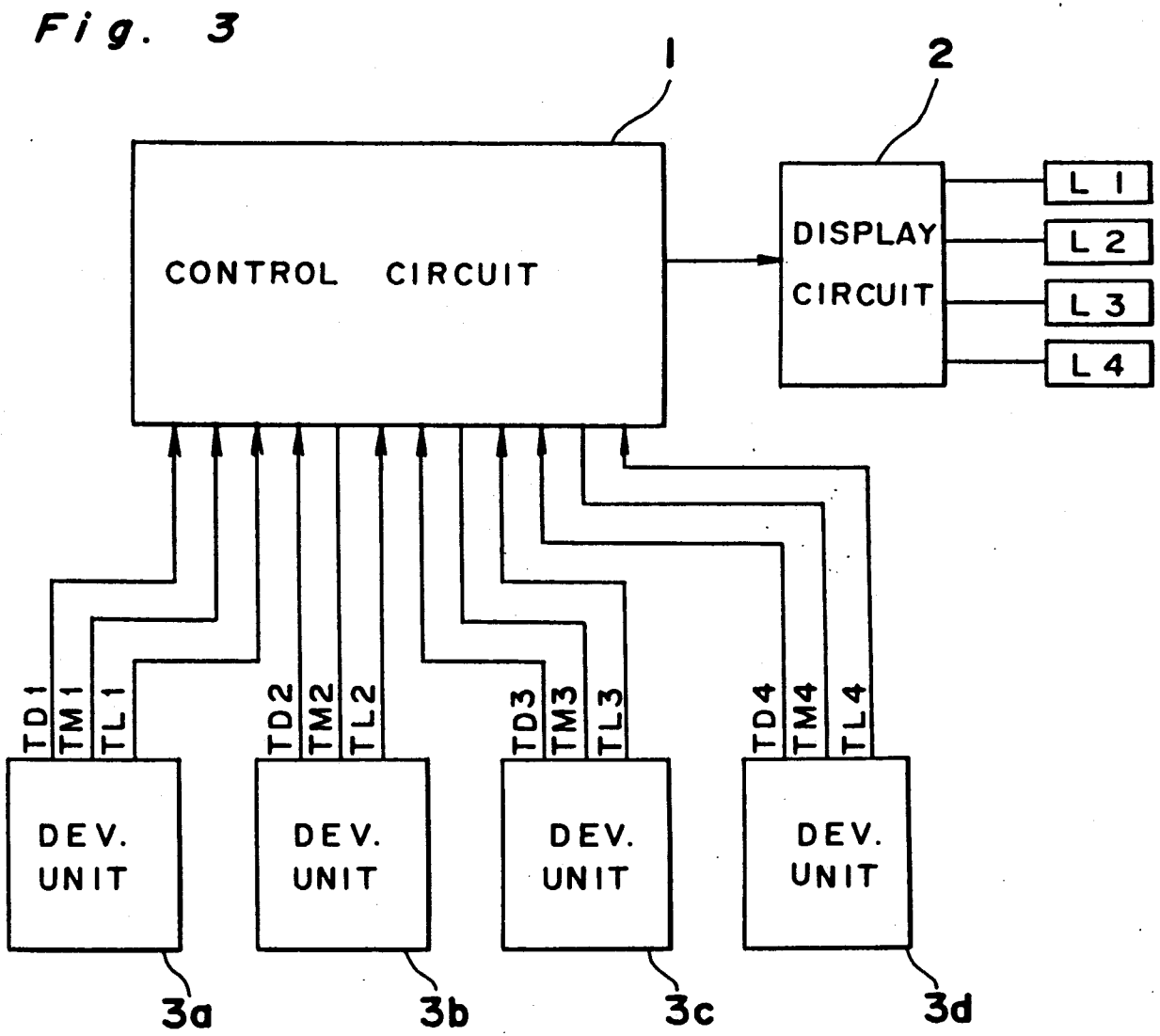
FIG. 3 is a block diagram showing connections in the control section for the developing apparatus according to the present invention.

Reference is also made to FIG. 3 showing connections in a control section of the developing apparatus of the present invention.

In FIG. 3, a control circuit 1 is coupled with the developing units 3*a*, 3*b*, 3*c* and 3*d*, and also, with a display circuit 2 which is further connected to replenishing display lamps L1, L2, L3 and L4.

To the control circuit 1, toner concentration signals TD1, TD2, TD3 and TD4, and toner level signals TL1, TL2, TL3 and TL4 are respectively applied from the respective developing units 3*a* through 3*d*, while driving signals TM1, TM2, TM3 and TM4 for the motors 11 are outputted from the control circuit 1 with respect to the developing units 3*a* through 3*d*. Moreover, display data are applied from the control circuit 1, to the display circuit 2, which illuminates the replenishing lamps L1 through L4 according to the display data. The replenishing display lamps L1 through L4 are provided on a control panel of an image forming apparatus (no particularly shown) equipped with the developing apparatus of the present invention as described above. These replenishing display lamps L1 through L4 correspond to the respective developing units 3*a* to 3*d*.

Figure 4:
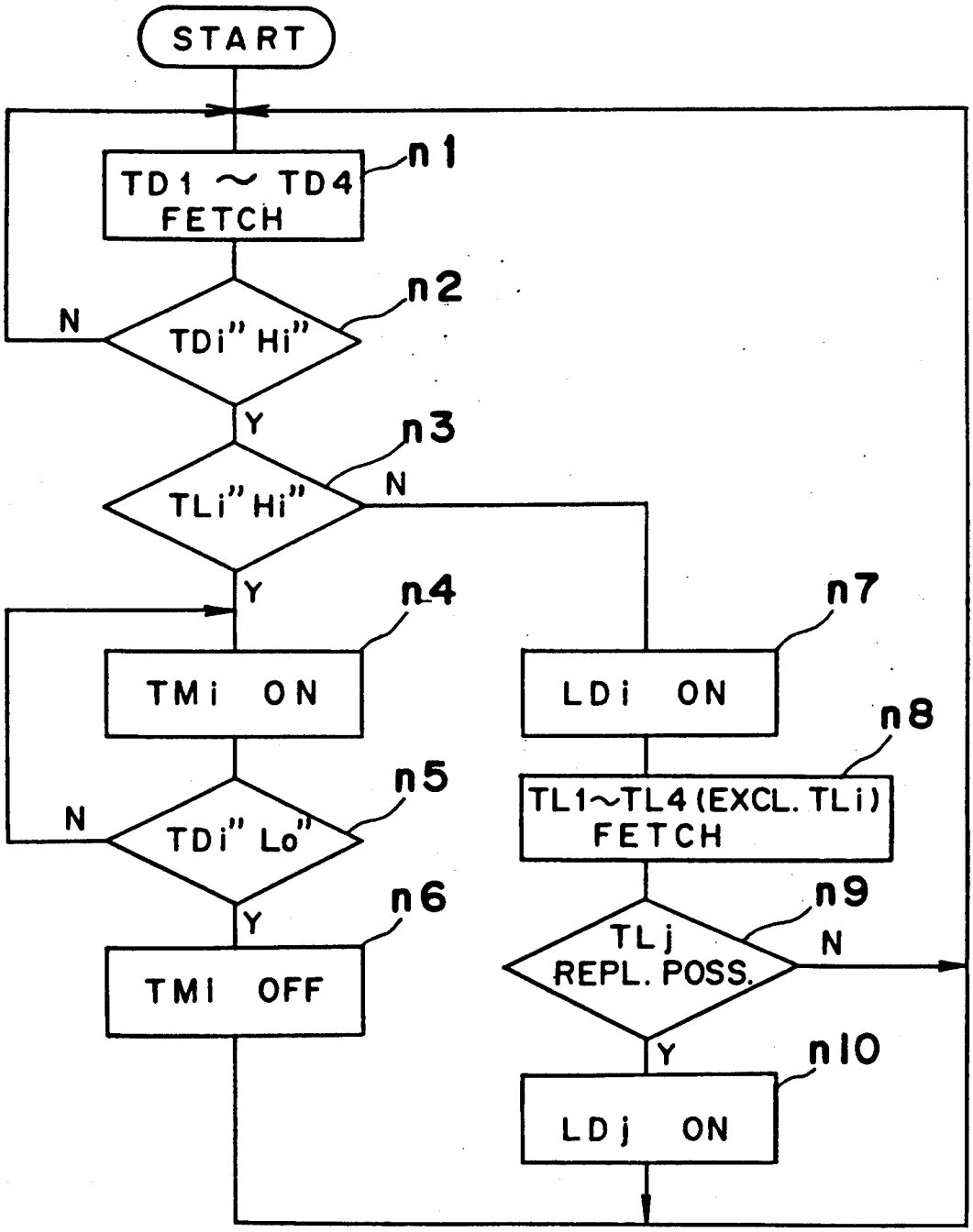
FIG. 4 is a flow-chart for explaining processing procedure in the control section for the developing apparatus of the present invention.

Referring further to a flow-chart in FIG. 4, processing procedures by the control circuit of the developing apparatus according to the present invention will be described hereinafter.

Upon turning on a power supply, the control circuit fetches the state of the toner concentration signal TD1 through TD4 (Step n1), and waits for any of the toner concentration signals TDi emitted by the respective permeability sensors 10 of the developing units 3*a* to 3*d*, to become "Hi" level (Step n2). In the case where the toner concentration within the developing tank 5 is lowered in any of the developing units 3*a* through 3*d*, the output voltage of the permeability sensor 10 of the developing unit 3 is raised. When the toner concentration of the developing material in the developing tank 5 falls below a reference value and the toner concentration signal TD becomes "Hi" level, the toner level signal TLi of the level sensor 9 possessed by the developing unit 3 is checked (Step n3). In the case where a sufficient amount of toner 6 is accommodated within the hopper 4, with the toner level signal TLi being of "Hi" level, the driving signal TMi for the motor 11 possessed by the developing unit 3 is outputted (Step n4), whereby the motor 11 is driven for rotation of the supply roller 12, and the toner 6 is supplied from the hopper 4 into the developing tank 5. Thus, the control circuit outputs the driving signal TMi to drive the motor 11 until the toner concentration signal TDi becomes "Lo" level as a result that a sufficient amount of toner has been fed into the developing tank 5, with a consequent rise of the toner concentration (Steps n4 through n6).

At Step n3, when the amount of toner 6 accommodated within the hopper 4 is insufficient and the output TLi of the level sensor 9 is of "Lo" level, it is judged that the toner replenishment is necessary, and the display data LDi for the display lamp Li corresponding to the developing unit 3 is outputted (Step n7). In other words, the replenishing requiring amount is the amount of toner in the state where the toner concentration within the developing tank 5 is low and the accommodated toner amount within the hopper 4 is small. Subsequently, the outputs TL1 through TL4 of the level sensors 9 (toner level signals) possessed by the developing units other than the developing unit requiring the toner replenishment are fetched (Step n8). If any of these toner level signals TL1 through TL4 (excluding TLi) is in the replenishable level, the display lamp corresponding the developing unit provided with the level sensor 9 which has outputted the toner level signal is illuminated (Steps n9,n10). In the above state, in the case where a plurality of toner level signals for the replenishable level are being outputted, the display lamps corresponding to all of the plurality of the developing units provided with the level sensors 9 outputting such toner level signals are illuminated. In other words, the replenishable amount represents the toner amount in the state where the amount of toner accommodated in the hopper 4 is small, although the toner concentration within the developing tank 5 is sufficiently high.

As is clear from the foregoing description, according to the present invention, it is so arranged that when the toner concentration of the developing material in the developing tank 5 is lowered, with the amount of toner accommodated within the hopper 4 being insufficient and the outputs of the level sensor 9 and permeability sensor 10 of the developing unit 3 become the replenishing requiring amount, the state of output of the level sensors 9 for the other developing units are checked. Thus, in the other developing units, if there is any unit in which the accommodated toner amount in the hopper 4 is reduced, with the output of the level sensor 9 falling below the replenishable amount, the display for urging the toner replenishment is also made with respect to such a developing unit. Therefore, during the toner replenishing work with respect to the developing unit which requires the toner replenishment, the operator can simultaneously effect toner replenishment for the developing unit in which the amount of toner accommodated in the hopper 4 has become insufficient.

Thus, according to the present invention, in the case where the replenishment of toner above a predetermined amount is possible in the other developing unit, during the toner replenishment with respect to the developing unit in which the toner has been used up, toner can be simultaneously replenished also with respect t such other developing unit, and thus, not only the frequency for the toner replenishing work may be reduced for improved workability, but higher working efficiency of the image forming apparatus can also be achieved at the same time.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developing apparatus comprising:

a plurality of developing units each including a hopper and a developing tank;

a permeability sensor provided in connection with the developing tank for each of said plurality of developing units, said permeability sensor automatically determining whether a concentration of toner within the developing tank is below a predetermined value;

a level sensor provided in connection with the hopper for each of said plurality of developing units, said level sensor automatically determining whether a level of toner within the hopper is below a predetermined level;

control means for controlling said permeability sensor and said level sensor, wherein detection by said permeability sensor of a concentration of toner below the predetermined value in a developing tank of any one of said plurality of developing units initiates detection by said level sensor in each hopper for each of said plurality of developing units for determining whether the level of toner therein is below the predetermined level; and means for indicating a need for toner replenishment in a respective one of said plurality of developing units in response to automatic determination by said level sensor.

2. A developing apparatus as claimed in claim 1, wherein said permeability sensor is provided on an outer wall of said developing tank, and so arranged that its output is increased as the toner concentration in said developing tank is decreased.

3. A developing apparatus as claimed in claim 1, wherein said level sensor is composed of a variable resistor for detecting variation in the amount of toner accommodated in said hopper as a displacement of an actuator movably disposed at part of said hopper for displacement according to the variation in the amount of accommodated toner, the output of said level sensor being lowered as the amount of toner accommodated within said hopper is reduced.

4. A developing apparatus comprising:

a plurality of developing units individually provided with sensor means for detecting amounts of toner accommodated therein;

judging means for judging whether or not toner accommodated in each remaining developing unit is below a predetermined amount when a sensor output of one developing unit indicates that an amount of toner is below a predetermined amount; and replenishing display means for urging toner replenishment, based on the result of said judging means, with respect to the developing unit having the sensor output below the predetermined amount and any of the remaining developing units whose sensor output indicates that toner accommodated therein is below the predetermined amount thereby enabling simultaneous replenishment of toner in more than one developing unit, wherein each of said plurality of developing units includes a developing tank and a hopper, said developing tank having a permeability sensor for detecting whether toner concentration within the tank falls below a predetermined value and said hopper having a level sensor for detecting whether an amount of toner therein falls below a predetermined level, wherein detection by said permeability sensor of toner below the predetermined value in any of said developing tanks initiates detection by said level sensor in each of said hoppers for determining whether the level of toner therein is below a predetermined value whereby said judging means indicates that toner is below a predetermined amount in a respective developing unit.

5. The developing apparatus as claimed in claim 4, wherein each of said developing tanks accommodates therein a developing material composed of toner and carrier, a magnet roller and stirring roller rotatably provided therein, wherein said hopper accommodates toner therein to be fed to said developing tank, and said developing tank being formed with an opening in its bottom wall through which opening part of said magnet roller confronts a surface of said photosensitive drum.

6. The developing apparatus as claimed in claim 5, wherein said magnetic permeability sensor is provided on an outer wall of said developing tank, and so arranged that its output is increased as the toner of the developing material in said developing tank is decreased corresponding to reduction of the toner concentration.

7. The developing apparatus as claimed in claim 5, wherein the predetermined amount represents the toner amount in the state where the toner concentration of the developing material within the hopper is small, with the toner concentration of the developing material in the developing tank being sufficiently high.

8. The developing apparatus as claimed in claim 5, wherein said level sensor is composed of a variable resistor for detecting variation in the amount of toner accommodated in said hopper as a displacement of an actuator movably disposed at part of said hopper for displacement according to the variation in the amount of the accommodated toner, the output of said level sensor being lowered as the amount of toner accommodated within the hopper is reduced.

9. The developing apparatus as claimed in claim 4, wherein said level sensor is composed of a variable resistor for detecting variation in the amount of toner accommodated in said hopper as a displacement of an actuator movably disposed at part of said hopper for displacement according to the variation in the amount of the accommodated toner, the output of said level sensor being lowered as the amount of toner accommodated within the hopper is reduced.

* * * * *